US008152254B2

(12) United States Patent
Kim

(10) Patent No.: US 8,152,254 B2
(45) Date of Patent: Apr. 10, 2012

(54) REFRIGERATOR

(75) Inventor: Jun Hee Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 562 days.

(21) Appl. No.: 12/180,133

(22) Filed: Jul. 25, 2008

(65) Prior Publication Data

US 2009/0026906 A1 Jan. 29, 2009

(30) Foreign Application Priority Data

Jul. 27, 2007 (KR) ..... 10-2007-0075736

(51) Int. Cl.
*A47B 96/04* (2006.01)

(52) U.S. Cl. ..... 312/402; 312/404; 312/331; 312/350; 464/901

(58) Field of Classification Search ..... 312/331, 312/402, 404, 334.1, 334.7, 350; 464/78, 464/113, 182, 901
See application file for complete search history.

(56) References Cited

U.S. PATENT DOCUMENTS 4,324,439 A * 4/1982 Hagen et al. ..... 384/18
6,499,818 B2 * 12/2002 Brustle ..... 312/319.1
6,848,759 B2 * 2/2005 Doornbos et al. ..... 312/319.1
6,851,775 B2 * 2/2005 Kaiser ..... 312/404
6,854,919 B2 * 2/2005 Neumann et al. ..... 403/326
7,059,211 B2 * 6/2006 Sasaki et al. ..... 74/422
7,594,707 B2 * 9/2009 Kunkle et al. ..... 312/402
7,997,667 B2 * 8/2011 Rotter et al. ..... 312/402
7,997,668 B2 * 8/2011 Lee ..... 312/402
2003/0173882 A1 * 9/2003 Koons ..... 312/404
2005/0160854 A1 * 7/2005 Rotter ..... 74/422
2009/0026906 A1 * 1/2009 Kim ..... 312/401
2009/0261698 A1 * 10/2009 Cabal Velarde et al. ... 312/334.8
2009/0302728 A1 * 12/2009 Rotter et al. ..... 312/404
2009/0322196 A1 * 12/2009 Park ..... 312/404
2010/0283365 A1 * 11/2010 Chen ..... 312/334.4
2011/0162402 A1 * 7/2011 Park ..... 62/264
2011/0210655 A1 * 9/2011 Brown et al. ..... 312/334.8
2011/0285266 A1 * 11/2011 Rotter et al. ..... 312/402

FOREIGN PATENT DOCUMENTS

KR 10-2007-0008046 A 1/2007

* cited by examiner

*Primary Examiner* — Darnell Jayne
*Assistant Examiner* — Daniel Rohrhoff
(74) *Attorney, Agent, or Firm* — Birch, Stewart, Kolasch & Birch, LLP

(57) ABSTRACT

A connection structure, for a refrigerator having a drawer door, of an anti-wobbling means which prevents the shaking phenomenon of a door is provided. There are advantages in that structural elements constituting the anti-wobbling means are easily connected to each other, and that a detachment between the structural elements is not occurred.

10 Claims, 5 Drawing Sheets

REFRIGERATOR

CROSS REFERENCES RELATED APPLICATIONS

The present application claims priority under 35 U.S.C. 119 and 35 U.S.C. 365 to Korean Patent Application No. 10-2007-0075736 (filed on Jul. 27, 2007), which is hereby incorporated by reference in its entirety.

THE BACKGROUND

1. The Field

This document relates to a refrigerator.

2. Description of the Related Art

Generally, a refrigerator is a household electric appliance for storing foods at low temperatures, and is configured to store the foods in either a frozen or a refrigerated state according to the condition of them to be stored.

Inside of the refrigerator is cooled by cold air, which is continuously supplied, and the cold air is continuously generated by a refrigerating cycle which repeatedly performs a cycle of compression, condensation, expansion and evaporation.

Further, the cold air supplied in the refrigerator is evenly transmitted into the inside of the refrigerator by the process of convection, so that foods in the refrigerator may be stored at a desired temperature.

In these years, this refrigerator is in a trend of becoming larger and multifunctional in connection with diversification of dietary pattern, and therefore products with various specifications and types are released onto the market.

The refrigerator is classified into a top mount-type refrigerator in which a freezing chamber is disposed above a refrigerating chamber, a bottom-freezer type refrigerator in which a freezing chamber is disposed below a refrigerating chamber, and a side-by-side-type refrigerator in which a freezing chamber and a refrigerating chamber are horizontally arranged side-by-side.

Generally, a freezing chamber of the bottom-freezer type is configured as a drawer, and the drawer is drawn when opening a freezing chamber door since the drawer is coupled with the freezing chamber door.

Further, a rail is provided at both sides of the drawer. The rail serves as a guide which guides an in-and-out movement of the drawer, some of the rail is fixed to a side of the freezing chamber, and another some of the rail is extended in a multistage manner and drawn out of the freezing chamber.

Meanwhile, large quantities of frozen foods are stored in the drawer, and in case the drawer is drawn by opening the freezing chamber door, some of the rail is fixed to the side of the freezing chamber and the other is drawn in a multistage manner.

Here, the rail is forced downward by a self weight of the drawer and a weight of the foods received in the drawer. And, in a state where the drawer is outwardly drawn, a moment is produced because a load is applied to an extended portion of the rail. By the application of force, there is a problem in that the rail is damaged when using it for extended periods of time.

Also, the door may be shaken while opening or closing the door. In other words, while the door is either pushed in or pulled out, a front surface of the door may not be maintained to be perpendicular to a side surface of the refrigerator main body. Then, the door is shaken to and fro, and therefore a bending moment or a torsional moment is exerted on a rail which supports the door. Accordingly, the lifetime of the rail is shortened.

In order to solve these problems, an anti-wobbling means containing a rack and a pinion is further provided so that the drawer and the door can be freely pushed in or pulled out without disturbances. However, there is a problem in that the pinion cannot use its ability because of difficulty in fixing it.

THE SUMMARY

The present invention is derived to solve the above conventional problems, and has an object to provide a rail structure to a refrigerator having a drawer door, which prevents the shaking phenomenon while the door is either pushed in or pulled out.

Also, another object of the present invention is to provide a rail structure which minimizes the phenomenon that a rail element is twisted by a weight exerted on the rail element guiding an in-and-out movement of a door.

To achieve these objects and other advantages and in accordance with the purpose of the invention, as embodied and broadly described herein, there is provided a refrigerator including: a main body in which a food storage space is provided; a door which selectively opens or closes the storage space through a back-and-forth movement; a storage element which is provided at a rear of the door to receive food; a rail element which connects an inner side surface of the storage space with the door so that the door can be moved; an anti-wobbling means which comprises a pair of rolling elements moving in a manner which contact a portion of the rail element and a connecting element connecting the rolling elements to each other, the anti-wobbling means configured to prevent the door from wobbling while moving; and a coupling means which connects the rolling element with the connecting element, wherein the coupling means comprises: a coupling projection formed at the connecting element; and a coupling hole formed at the rolling element in order to allow the coupling projection to be inserted therein.

In a refrigerator according to embodiments of the present invention, by means of a rolling element and a connecting element provided at a rear end of a storage element, the storage element can be stably either pushed in or pulled out.

Also, the rolling element and the connecting element are connected such that they can be slightly shaken in a longitudinal direction of the connecting element and be prevented from being detached from one another. As a result, improved convenience of use is preferably achieved, because the storage element can be stably pushed in or pulled out.

Also, enhanced reliability on products is preferably achieved, since the lifetime of the rail element is lengthened because the storage element is prevented from being twisted.

THE DETAILED DESCRIPTION

Reference will now be made in detail to the preferred embodiments of the present invention, examples of which are illustrated in the accompanying drawings. It will nevertheless be understood that no limitation of the scope of the invention is thereby intended, such alterations and further modifications and embodiments thereof, and such further applications of the principles of the invention as illustrated therein being contemplated as would normally occur to one skilled in the art to which the invention relates.

Figure 1:
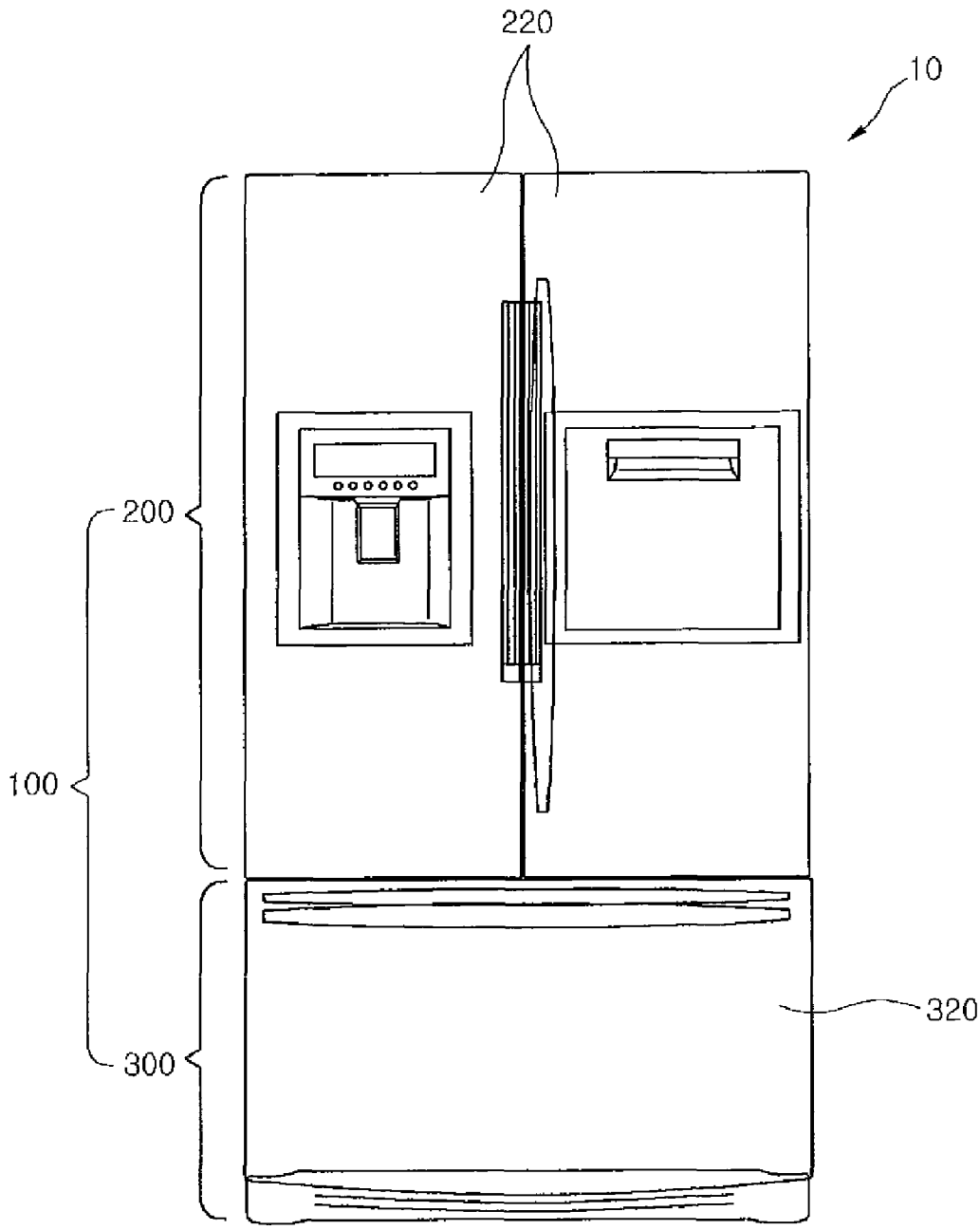
FIG. 1 is a front view showing an external appearance of a refrigerator according to an embodiment of the present invention.

FIG. 1 shows an external appearance of a refrigerator according to an embodiment of the present invention, in a front view.

Referring to FIG. 1, an overall external appearance of the refrigerator 10 according to the present invention is defined by a main body 100 in which a storage space is formed, and a door 320 which selectively closes the storage space of the main body 100.

The storage space in the main body 100 is horizontally divided, a refrigerating chamber 200 is formed at an upper part and a freezing chamber 300 is formed at a lower part. An opened front surface of the refrigerating chamber 200 is selectively opened or closed by a pair of rotary-type doors 220. And, an opened front surface of the freezing chamber 300 is selectively opened or closed by the door 320 which is either pushed in or pulled out in the manner of a drawer.

Figure 2:
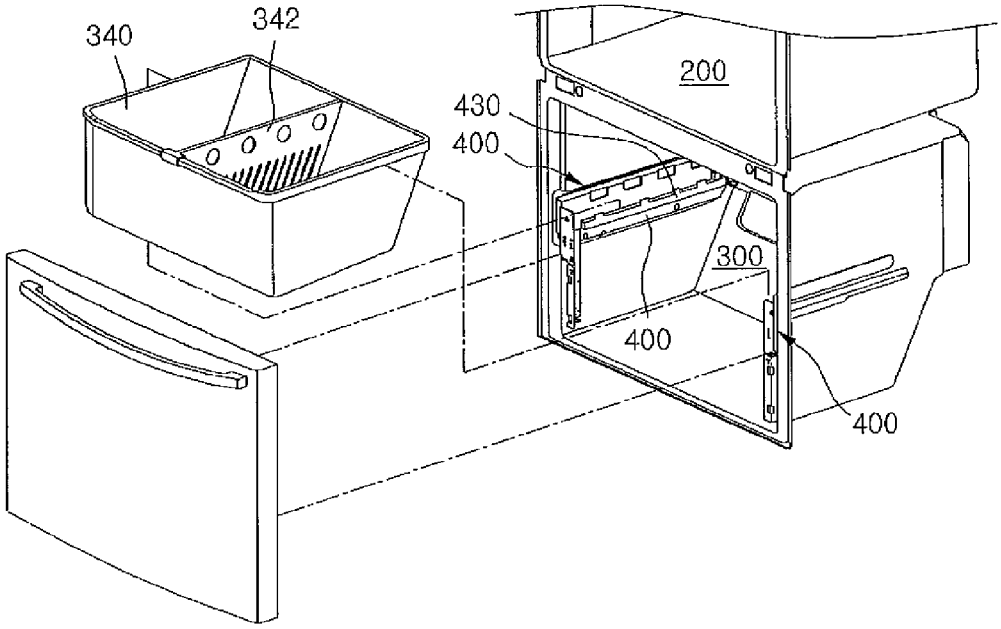
FIG. 2 is an exploded perspective view showing a structure of a drawer storage space of a refrigerator according to an embodiment of the present invention.

FIG. 2 shows a structure of a drawer storage space of a refrigerator according to an embodiment of the present invention, in an exploded perspective view.

Referring to FIG. 2, a storage element 340, which is slid in or slid out by engaging with the in-and-out movement of the door 320, is provided in the freezing chamber 300.

The storage element 340, which is a container where food can be received, is formed of a common plastic material or a wire material, and it is configured to be selectively separated from an inside of the freezing chamber 300.

The storage element 340 is formed to have a width corresponding to an inner transverse dimension of the freezing chamber 300, and it is configured to be able to store food items through an opened upper surface thereof. And, an inside of the storage element 340 may be divided into left and right spaces by a partition 342. Further, the size of the divided space can be adjusted by the movement of the partition 342.

Meanwhile, a rail element 400 is provided between the storage element 340 and a wall surface of the main body 100. More specifically, the storage element 340 is coupled with a seat part 430 and is slid in or slid out of the main body 100 by the rail element 400.

Here, the storage element 340 is configured to be stably pushed in or pulled out by the operation of a rolling element (see the reference numeral 520 in FIG. 3), which will be described below, and of a rack 440 which is one constituent of the rail element 400, and the connection relation between them will be explained in detail below.

Figure 3:
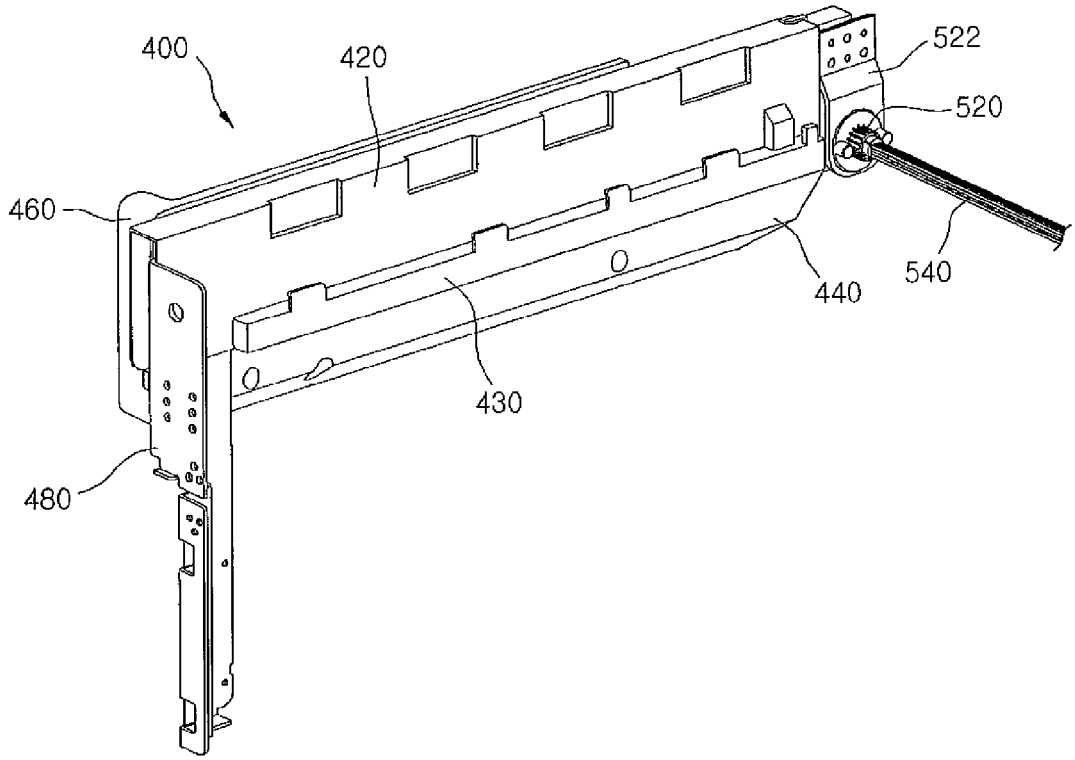
FIG. 3 is an external perspective view of a rail element of a refrigerator according to an embodiment of the present invention.
Figure 4:
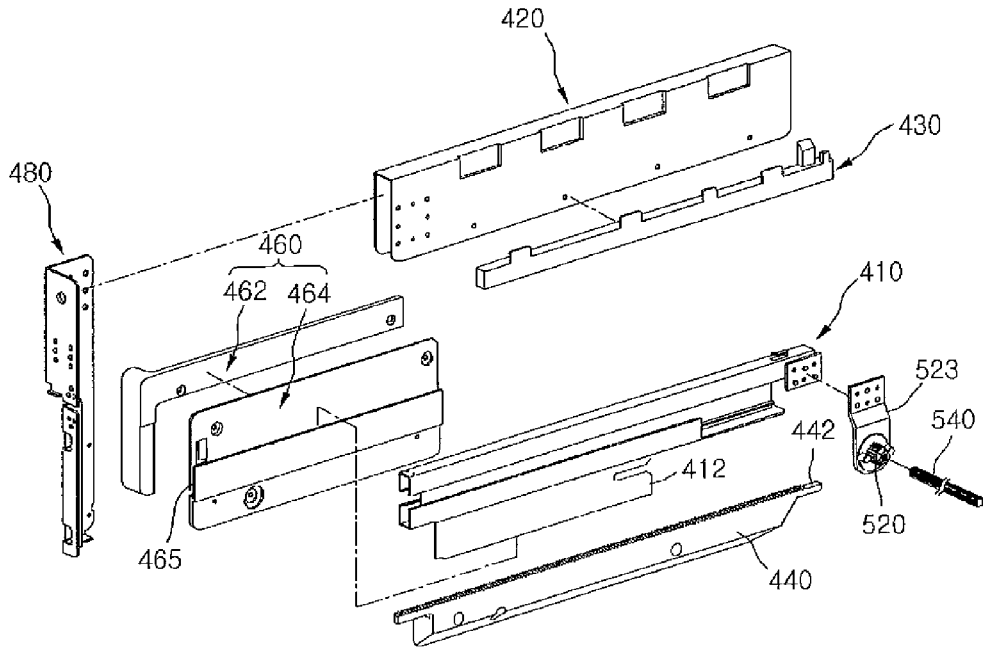
FIG. 4 is an exploded perspective view of the rail element.

FIG. 3 shows a rail element of a refrigerator according to an embodiment of the present invention in an external perspective view, and FIG. 4 shows the rail element in an exploded perspective view.

Referring to FIGS. 3 and 4, the rail element 400 according to a preferred embodiment of the present invention is configured to be attached to an inner wall surface of the main body 100 by a fixing element 460. The fixing element 460 comprises a cover 462 and a plate 464, the cover is formed in a shape surrounding a front end and a top of the plate 464. And, the front end of the cover 462 is installed at an edge region where a front surface and a side surface of the freezing chamber 300 are met.

The plate 464 is formed in the shape of an approximate rectangular plate, and a fixing slot 465 in which a mounting bracket 412 of the rail element 400 is inserted is formed therein. Specifically, an upper part of the fixing slot 465 is opened so that the mounting bracket 412 can be inserted therein, and the fixing slot 465 is formed long from a front end to a rear end of the plate 464.

Meanwhile, the rail element 400 includes a rail part 410 which can adjust its length in a pulling direction of the door 320, a cover part 420 which covers the rail part 410, a seat part 430 which is connected to a lower side of the cover part 420 so that a side surface of the storage element 340 is fixed, and a rack 440 which is connected to a lower side of the seat part 430 in order to provide a movement route of the rolling element 520 (which will be explained below).

In detail, the rail part 410 is configured to be pulled out in a multistage manner so that the length thereof can be extended, and a mounting bracket 412 to be fitted into the fixing slot 465 is formed at a lower end of the rail part 410.

The cover part 420 is seated on the rail part. The cover part 420 is formed to have an approximate "∩" shape, so that it covers an exterior of the rail part 410. Therefore, the rail part 410 is not exposed from a side by the cover part 420.

A door frame 480 is connected to a front end of the cover part 420. The door frame 480, which connects the door 320 with the rail element 400, is connected to both side ends of the door 320 at a bottom surface of the door 320. And, the door frame 480 is formed to have a predetermined length from an upper part and to a lower part of the door 320.

A lateral cross-section of the door frame 480 is bent in an approximate '¬' shape, a bent surface is connected to a bottom surface of the door 320 and some of the other bent surface is connected to the cover part 420. Therefore, the rail element 400 is pushed in or pulled out according to the in-and-out movement of the door 320.

Meanwhile, a seat part 430 is provided at a side surface of the cover part 420, that is at a surface adjacent to the storage element 340. The seat part 430 allows the storage element 340 to be mounted thereon, and it is extended from a front end to a rear end of the cover part 420.

At a lower side of the seat part 430, a rack 440 which allows the storage element 340 to be stably pushed in or pulled out by cooperating with a rolling element 520 (which will be described below) is provided.

A gear tooth is formed on an upper surface of the rack 440, so that it guides the rolling element 520 while the rail part 410 is pushed in or pulled out. And, an aligning part 442 where a gear tooth is not formed is further provided at a rear end of the rack 440. The aligning part 442 is a means which corrects an installation-caused error when the door 320 is pushed in while being obliquely installed in a back-and-forth direction. Specifically, in case the door 320 is not pushed in while being perpendicular to a side surface of the refrigerator main body but obliquely pushed in, one of the rolling elements 520 arrives at the aligning part 442 before the other. Here, the arrived rolling element 520 is idling at the aligning part 442 until the other rolling element 520 arrives at the aligning part 442. Then, the door 320 is perpendicular to the side surface of the refrigerator main body when the door 320 is fully pushed in.

Meanwhile, the rolling element 520 is seated on an upper surface of the rack 440, and a pair of rolling elements 520 are connected to each other by a connecting element 540. And, By means of an anti-wobbling means comprising the connecting element 540 and of the rolling element 520, the storage element 340 is prevented from being twisted or shaken while being pushed in or pulled out.

In detail, a pinion 521 is formed on an outer circumferential surface of the rolling element 520, and a connecting part 522 is extended toward a rotation axis. And, a cavity part is formed in the connecting part 522 such that an end of the connecting element 540 is inserted therein. And, the pinion 521 is fixed to a rear, side surface of the rail part 410 by a bracket 523. Further, the pinion 521 is rotated by engaging with a gear tooth formed on the upper surface of the rack 440.

In addition, the pair of rolling elements 520 are connected by the connecting element 540. Specifically, an inserting part 541 to be inserted into the connecting part 522 is formed at both side ends of the connecting element 540. The connecting element 540 and the rolling element 520 can be integrally rotated, as the connecting element 540 is formed in a rod shape, and the inserting part 541 and the connecting part 522 are formed in the shape of a polygon.

Hereinafter, the connection relation between the rolling element and the connecting element will be explained in detail with reference to the accompanying drawings.

Figure 5:
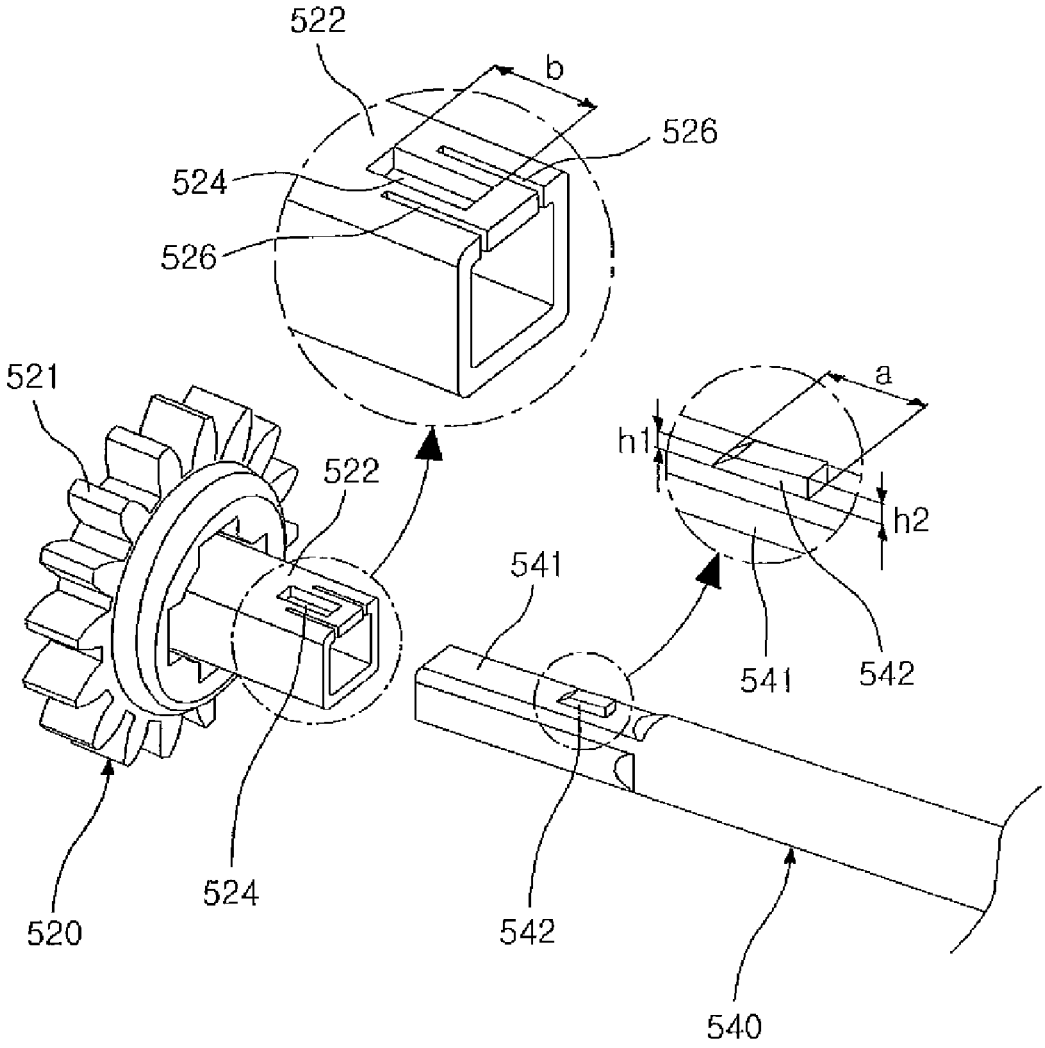
FIG. 5 is an exploded perspective view showing the connection relation of an anti-wobbling means of a refrigerator according to an embodiment of the present invention.

FIG. 5 shows the connection relation of an anti-wobbling means of a refrigerator according to an embodiment of the present invention, in an exploded perspective view.

Referring to FIG. 5, as described in the above, the anti-wobbling means includes a pair of rolling elements 520 which rotates along the rack 440, and a connecting element 540 which connects the pair of rolling elements 520 to each other. And, the rolling element 520 and the connecting element 540 are connected by a coupling means.

In detail, the coupling means prevents the connecting element 540 from detaching from the rolling element 520 and connects them in a manner that they can be shaken to a specific length in proportion to a width of the freezing chamber. More specifically, the coupling means includes a coupling projection 542 protruded on an outer circumferential surface of the inserting parts 541 which are formed at both ends of the connecting element 540, and a coupling hole 524 formed at the connecting part 522 of the rolling element 520 so that the coupling projection 542 is inserted therein.

The coupling projection 542 is obliquely formed for allowing the height thereof to be increased from an end, where a contact with the connecting part 522 occurs, toward a rear ($h1<h2$). That is, the coupling projection 542 is configured that a front end thereof is formed to be low in height to facilitate the insertion of the coupling projection 542, and that a rear end thereof is formed to be high in height to prevent the coupling projection 542 from being easily detached after the coupling projection 542 is inserted. And, the front end of the coupling projection 542 is tapered at a predetermined angle, so that the coupling projection 542 can be smoothly inserted into the connecting part 522.

Meanwhile, the coupling hole 524 is formed longer than the coupling projection 542, and therefore the coupling projection 542 is accommodated therein. Specifically, a length b of the coupling hole 524 is formed to be slightly longer than or equal to a length a of the coupling projection 542 ($b \geqq a$), so that the coupling projection 542 allows the connecting element 540 to slightly shake in a longitudinal direction. That is, a gap of the rolling element 520 can be adjusted in response to an inner width of the freezing chamber. Accordingly, the storage element 340 is prevented from being twisted or shaken, and thus, the storage element 340 is stably pushed in or pulled out.

At both sides of the coupling hole 524, an elastic groove 526 for facilitating the insertion of the coupling projection 542 is formed. The elastic groove 526 is configured by incising both side portions of the coupling hole 524 in a predetermined length. By means of this elastic groove 526, a region where the coupling hole 524 is formed is slightly lifted by an elastic deformation at the moment when the coupling projection 542 is inserted. And, the insertion of the coupling projection 542 is easily achieved, since a surface where the coupling hole 524 is return to its original location after the coupling projection 542 is fully inserted.

Hereinafter, the operation of the refrigerator having this structure will be explained in detail with reference to FIGS. 1 to 5.

In case of pulling out the door 320 forward, the storage element 340 is pulled out forward as the rail part 410 is extended while sliding. Here, the rolling element 520 connected to a rear end of the rail part 410 is also pulled out forward together with the rail part 410.

In that case, the rolling element 520 moves forward while rotating, because it is connected with a gear tooth formed on an upper surface of the rack 440. Further, since the rolling elements 520 which are respectively provided at both rail parts 410 are connected by a connecting element 540, the rolling elements 520 are rotated together and a rail element 400 is extended to the same length as the other.

Therefore, when an user pulls out the door 320, the storage element 340 and the rail elements 400, including the door 320 can be stably pulled out forward without being inclined to either side nor shaken even through force is biasedly exerted on either side.

Specifically, the rolling element 520 moves along the rack 440 because it is mated with the rack 440, and the respective rolling element 520 is integrally moved by the connecting element 540. And, the rolling element 520 and the connecting element 540 are connected in a manner that they can be moved. Therefore, the storage element 340 can be stably pulled out, since the force biased in either direction is absorbed even when the storage element 340 is inclined to either side.

Thereafter, when pushing in the storage element 340, the same operation is also performed as in case of pulling out the storage element 340.

What is claimed is:

1. A refrigerator, comprising:

a main body in which a food storage space is provided;

a door which selectively opens or closes the storage space through a back-and-forth movement;

a storage element which is provided at a rear of the door to receive food;

a rail element which connects an inner side surface of the storage space with the door so that the door can be moved;

an anti-wobbling means which comprises a pair of rolling elements moving in a manner which contact a portion of the rail element and a connecting element connecting the rolling elements to each other, the anti-wobbling means configured to prevent the door from wobbling while moving;

a coupling means which connects the rolling element with the connecting element; and a fixing element which comprises a cover and a plate, wherein the coupling means comprises:

a coupling projection formed at the connecting element; and a coupling hole formed at the rolling element in order to allow the coupling projection to be inserted therein, wherein the rail element comprises a rack which provides a movement route of the rolling element, wherein an aligning part where a gear tooth is not formed is further provided at a rear end of the rack, and the aligning part corrects an installation-caused error when the door is pushed in while being obliquely installed in a back-and-forth direction, wherein the cover is installed on the main body, and wherein a fixing slot in which a part of the rail element is inserted is formed on the plate.

2. The refrigerator according to claim 1, wherein one end of the coupling projection is tapered at a predetermined angle.

3. The refrigerator according to claim 1, wherein the rolling element comprises a pinion and a connecting part which is extended in the direction of a rotation axis of the pinion, and wherein the coupling hole is formed in the connecting part.

4. The refrigerator according to claim 3, wherein an end of the connecting element is inserted into the connecting part.

5. The refrigerator according to claim 3, wherein an end of the connecting element and the connecting part have a polygonal cross-section.

6. The refrigerator according to claim 3, wherein the coupling projection is obliquely formed so that one end thereof is higher than the other end thereof.

7. The refrigerator according to claim 3, wherein a portion of the connecting part, where the coupling hole is formed, is elastically deformed while an end of the connecting element is inserted.

8. The refrigerator according to claim 3, wherein an elastic groove of a predetermined depth is formed at locations spaced apart from both side ends of the coupling hole.

9. The refrigerator according to claim 3, wherein the coupling hole is formed to have a length which is equal to or slightly longer than a length of the coupling projection.

10. The refrigerator according to claim 1, wherein the cover is installed at an edge region where a front surface and a side surface of the main body meet, wherein a mounting bracket of the rail element is inserted in the fixing slot wherein an upper part of the fixing slot is opened so that the mounting bracket is insertable therein, and wherein the rail element comprises a rail part that is configured to adjust its length in a pulling direction of the door, and the mounting bracket to be fitted into the fixing slot is formed at a lower end of the rail part.

* * * * *